US011401785B2

(12) United States Patent
Sun et al.

(10) Patent No.: US 11,401,785 B2
(45) Date of Patent: Aug. 2, 2022

(54) WELL STRUCTURE FOR NATURAL GAS HYDRATE PRODUCTION

(71) Applicants: China University of Petroleum (East China), Qingdao (CN); Selskapet Gudme Stad AS, Tananger (NO); CIMC Offshore Engineering Research Institute Co. Ltd., Yantai (CN)

(72) Inventors: Baojiang Sun, Qingdao (CN); Ove Tobias Gudmestad, Tananger (NO); Xuefeng Li, Qingdao (CN); Dahui Liu, Yantai (CN); Litao Chen, Qingdao (CN)

(73) Assignees: CHINA UNIVERSITY OF PETROLEUM (EAST CHINA), Qingdao (CN); SELSKAPET GUDME STAD AS, Tananger (NO); CIMC OFFSHORE ENGINEERING RESEARCH INSTITUTE CO. LTD., Yantai (CN)

( * ) Notice: Subject to any disclaimer, the term of this patent is extended or adjusted under 35 U.S.C. 154(b) by 0 days.

(21) Appl. No.: 16/869,166

(22) Filed: May 7, 2020

(65) Prior Publication Data

US 2021/0254438 A1 Aug. 19, 2021

(30) Foreign Application Priority Data

Feb. 13, 2020 (CN) ..... 202010090622.3

(51) Int. Cl.
*E21B 41/00* (2006.01)
*E21B 17/01* (2006.01)
(Continued)

(52) U.S. Cl.
CPC ..... *E21B 41/0099* (2020.05); *E21B 17/01* (2013.01); *E21B 34/06* (2013.01);
(Continued)

(58) Field of Classification Search
CPC .... E21B 41/0099; E21B 43/305; E21B 43/24; E21B 43/38; E21B 43/08; E21B 43/06; E21B 43/128; E21B 17/01
See application file for complete search history.

(56) References Cited

U.S. PATENT DOCUMENTS 4,460,044 A * 7/1984 Porter ..... E21B 43/305 166/191
4,770,255 A * 9/1988 Barthelemy ..... E21B 21/001 175/6
(Continued)

FOREIGN PATENT DOCUMENTS

CN 1786416 A 6/2006
CN 101864937 A 10/2010
(Continued)

OTHER PUBLICATIONS

Oiu, S. et al. "Structual Design and Optimization of In-situ Purification Separator for Submarine Gas Hydrate" (2019) China Offshore Oil and Gas. 31(2): 1673-1506.
(Continued)

*Primary Examiner* — Nicole Coy
*Assistant Examiner* — Yanick A Akaragwe
(74) *Attorney, Agent, or Firm* — Volpe Koenig

(57) ABSTRACT

The present invention relates to the field of natural gas production, and discloses a well structure for natural gas hydrate production, which comprises: a natural gas production well (12); an injection well (4) capable of extending into a geothermal reservoir and injecting a heat-carrying fluid; a curved connecting well (7), the inlet end of the curved connecting well (7) is connected to the outlet end of the injection well (4); a hydrate production horizontal well (10), which may be arranged in a shallow hydrate reservoir (9), the curved connecting well (7) and the hydrate production horizontal well (10) are connected by an ascending well
(Continued)

section (8). With the above technical scheme, the high curvature connected well connecting the horizontal well and the vertical well can be located in the bottom layer below the hydrate reservoir, enhancing the stability and production efficiency of the gas hydrate production well.

9 Claims, 1 Drawing Sheet

(51) Int. Cl.

| | |
|---|---|
| ***E21B 34/06*** | (2006.01) |
| ***E21B 43/08*** | (2006.01) |
| ***E21B 43/12*** | (2006.01) |
| ***E21B 43/24*** | (2006.01) |
| ***E21B 43/30*** | (2006.01) |
| ***E21B 43/38*** | (2006.01) |

(52) U.S. Cl.
CPC ..... *E21B 43/08* (2013.01); *E21B 43/128* (2013.01); *E21B 43/24* (2013.01); *E21B 43/305* (2013.01); *E21B 43/38* (2013.01)

(56) References Cited

U.S. PATENT DOCUMENTS

| | | | | |
|---|---|---|---|---|
| 4,901,413 | A * | 2/1990 | Cotherman | E21B 43/38 29/401.1 |
| 5,040,283 | A * | 8/1991 | Pelgrom | E21B 33/138 29/447 |
| 5,655,605 | A * | 8/1997 | Matthews | E21B 43/121 166/370 |
| 9,309,473 | B2 * | 4/2016 | McAlister | B01J 7/00 |
| 2003/0085185 | A1 * | 5/2003 | Kouba | B01D 17/0211 210/787 |
| 2014/0299311 | A1 | 10/2014 | Zupanick | |
| 2015/0090455 | A1 * | 4/2015 | Balczewski | E21B 43/24 166/303 |

FOREIGN PATENT DOCUMENTS

| | | | |
|---|---|---|---|
| CN | 102704902 | A | 10/2012 |
| CN | 106837206 | A | 6/2017 |
| CN | 108678724 | A | 10/2018 |
| CN | 109252833 | A | 1/2019 |
| WO | 2015/013234 | A3 | 1/2015 |

OTHER PUBLICATIONS

Na, S. et al. "Discussion on Natural Gas Hydrate Production Technologies" (2016) China Petroleum Production. 21(5): 52-61.

Jiang, B. et al. "Economic Evaluation of Using Thermal Seawater Injection in Double-branch Horizontal Wells for Submarine Natural Gas hydrate Exploration" (2015) Oil Driling & Production Technology. 37(1): 87-91.

* cited by examiner

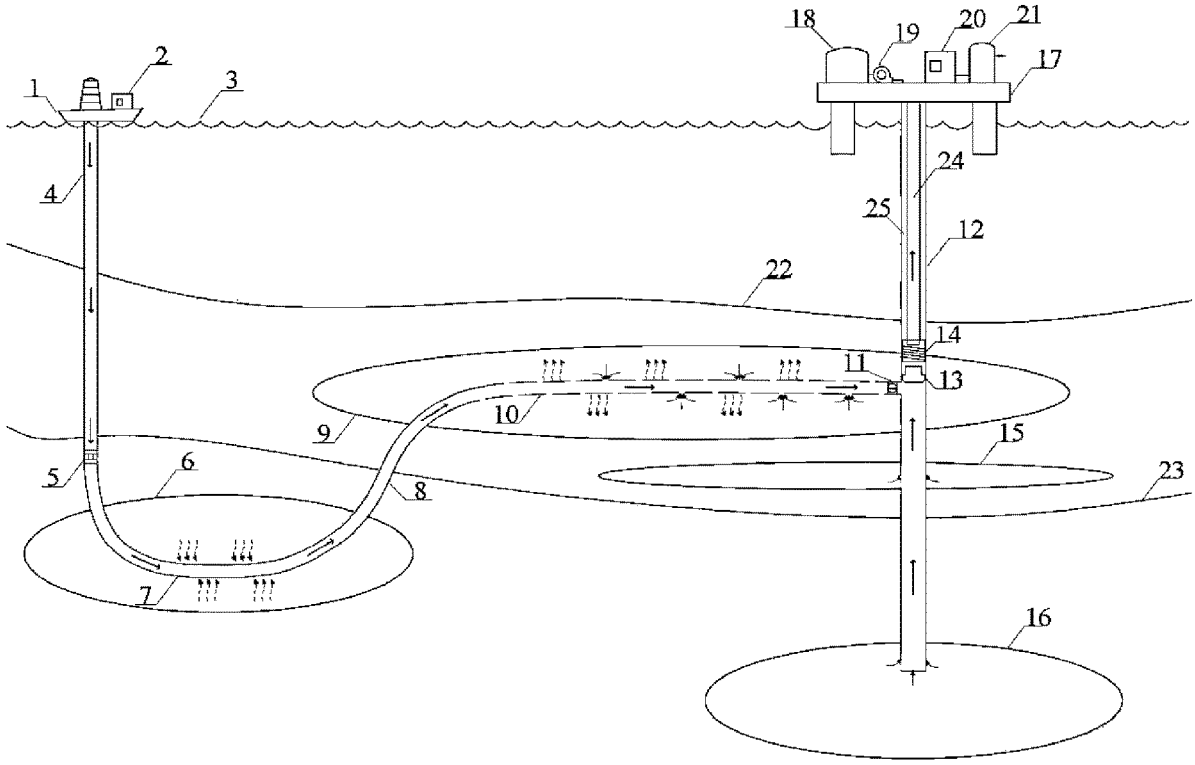
1
2
3
4
5
6
7
8
9
10
11
12
13
14
15
16
17
18
19
20
21
22
23
24
25

WELL STRUCTURE FOR NATURAL GAS HYDRATE PRODUCTION

CROSS REFERENCE TO RELATED APPLICATION

This application claims the benefit of priority to Chinese Application No. 202010090622.3, filed on Feb. 13, 2020, entitled "Well Structure for Natural Gas Hydrate Production", the entirety of which is incorporated herein by reference.

FIELD

The present invention relates to the field of natural gas production, in particular to a well structure for natural gas hydrate production.

BACKGROUND

Natural gas hydrates are a sort of clean energy with abundant reserve, and are widely distributed in continental permafrost regions, polar continental shelves, and deep water environments in oceans and some inland lakes in the natural world. The total organic carbon content in the natural gas hydrates in the globe is two times of that in other fossil energy resources. Therefore, natural gas hydrates are expected to be a new energy resource in replacement of traditional fossil fuels.

The exploitation of marine hydrate resources by horizontal wells can improve the efficiency of hydrate extraction, but the shallow geological structure of the seabed is loose, the inclined well sections of horizontal wells are unstable, and they are prone to collapse.

SUMMARY

The object of the present invention is to provide a well structure for natural gas hydrate production to solve the existing problems of unstable horizontal wells in the seabed hydrate layer.

To attain the above object, the present invention provides a well structure for natural gas hydrate production, which comprises:

a natural gas production well;

an injection well capable of injecting a heat-carrying fluid;

a high curvature connecting well, the inlet end of the high curvature connecting well is connected to the outlet end of the injection well;

a hydrate production horizontal well, which may be arranged in a shallow hydrate reservoir, the high curvature connecting well and the hydrate production horizontal well are connected by an ascending well section, and the hydrate production horizontal well is connected to the natural gas production well.

Optionally, the upper part of the natural gas production well is provided with an inner riser pipe therein, and a riser annulus is formed between the natural gas production well and the inner riser pipe.

Optionally, the lower end of the inner riser pipe is provided with a downhole separator, which is in connect with the inner riser pipe and the riser annulus.

Optionally, the natural gas production well is provided with a driving pump therein, which is in connect with the downhole separator.

Optionally, the driving pump is adjacent to the outlet end of the hydrate production horizontal well.

Optionally, the hydrate production horizontal well is provided with a memory alloy screen pipe therein.

Optionally, the high curvature connected well can absorb heat in the formation below the hydrate reservoir.

Optionally, the outlet end of the hydrate production horizontal well is provided with a check valve.

Optionally, the lower part of the natural gas production well may be in connect with a shallow free gas formation zone and a deep gas reservoir zone.

Optionally, the inlet end of the injection well is arranged on a mobile barge, which is provided with an injection circulating pump connected to the injection well.

Optionally, the outlet end of the natural gas production well is installed on an offshore platform, which is provided with a fine gas-liquid separation device, a recovery circulating pump, a natural gas recovery tank and a liquid recovery tank.

With the above technical scheme, the deflecting well section of the gas hydrate well can be set in deeper strata, which effectively reduces the risk of deflection and instability of the gas hydrate well. The separation of the injection well and the production well can expand the hydrate production efficiency, the heat in the geothermal reservoir may be utilized to decompose a natural gas hydrate in the shallow hydrate reservoir, so that the decomposed natural gas enters the hydrate production horizontal well and the natural gas production well, and rapid and stable natural gas hydrate production can be realized.

BRIEF DESCRIPTION OF THE DRAWING

FIG. 1 is a schematic diagram of the well structure for natural gas hydrate production according to an embodiment of the present invention.

REFERENCE NUMBERS

1—mobile barge; 2—injection circulating pump; 3—sea level; 4—injection well; 5—pressuring device; 6—formation below the hydrate reservoir; 7—high curvature connecting well; 8—rising well section; 9—shallow hydrate reservoir; 10—hydrate production horizontal well; 11—check valve; 12—natural gas production well; 13—driving pump; 14—downhole separator; 15—shallow free gas formation zone; 16—deep gas reservoir zone; 17—offshore platform; 18—natural gas storage tank; 19—fine gas-liquid separation device; 20—recovery circulating pump; 21—liquid recovery tank; 22—mudline; 23—diagenetic sedimentary formation; 24—inner riser pipe; 25—riser annulus.

DETAILED DESCRIPTION

Hereafter some embodiments of the present invention will be detailed with reference to the accompanying drawings. It should be understood that the embodiments described herein are only provided to describe and explain the present invention rather than constitute any limitation to the present invention.

In the present invention, unless otherwise specified, the terms that denote orientations are used as follows; for example, "top" and "bottom" usually refer to top and bottom in the position relationship of the natural gas production well structure in installation and operation states; in addition, the "well" mentioned in this scheme may be a well structure formed by the stratigraphic structure itself (i.e. a hole formed in the stratigraphic structure) or an artificial tubular structure.

The present invention provides a well structure for natural gas hydrate production, which comprises:

a natural gas production well 12;

an injection well 4 capable of injecting a heat-carrying fluid;

a high curvature connecting well 7, with the inlet end of the high curvature connecting well 7 connected with the outlet end of the injection well 4;

a hydrate production horizontal well 10, which may be arranged in a shallow hydrate reservoir 9 and connected with the natural gas production well 12, the high curvature connecting well 7 and the hydrate production horizontal well 10 are connected by an rising well section 8

In the well structure for natural gas hydrate production, the natural gas production well 12 is the main structure, which may extend into the formation from the sea level 3 and thereby may be in interconnect with the natural gas reservoir zone in specific strata.

The injection well 4, the high curvature connecting well 7, the ascending well section 8 and the hydrate production horizontal well 10 are connected in sequence (directly or indirectly), the upper inlet end of the injection well 4 is approximately located at the sea level 3 (e.g., the mobile barge 1 described below), a heat-carrying fluid can be injected through the injection well 4, and a pressurizing device 5 may be arranged at the lower end of the injection well 4 in the diagenetic sedimentary formation 23, so as to provide power for the fluid in the well when the fluid pressure in the well is inadequate;

Both ends of the high-curvature communication well 7 are bent upward, which makes the high-curvature connecting well 7 form a curved shape as a whole; the high-curvature connecting well 7 is deeper than the hydrate production horizontal well 10. (e.g., the high-curvature connecting well 7 is provided in the diagenetic sediment layer 23 below the shallow hydrate reservoir 9, that is, the formation 6 below the hydrate reservoir shown in FIG. 1.)

Referring to FIG. 1, the depth of the formation below the hydrate reservoir 6 and the shallow hydrate reservoir 9 are different. The depth of the formation below the hydrate reservoir 6 is relatively large, which is located in the diagenetic sediment layer 23 The shallow hydrate reservoir 9 is located above the diagenetic sediment layer 23 and below the mudline 22. Therefore, the high curvature connecting well 7 and the hydrate production horizontal well 10 need to be connected by a rising well section 8 (vertical or inclined). Among them, referring to FIG. 1, the deflecting section from the injection well 4 to the high curvature connecting well 7 is located in the diagenetic sedimentary layer 23, and the deflecting section from the high curvature connecting well 7 to the hydrate production horizontal well 10 is located in the diagenetic sedimentary layer 23. The deflection section of the horizontal well 10 for hydrate mining is prevented from appearing near the mudline 22, for enhance the stability of the wellbore is achieved.

the hydrate production horizontal well 10 located in the shallow hydrate reservoir 9, the pressure of the fluid in the hydrate production horizontal well 10 will be slightly lower than the reservoir pressure to break the phase equilibrium condition in the shallow hydrate reservoir 9 and promote the decomposition of natural gas hydrate; as the natural gas hydrate is decomposed, the decomposed natural gas enters the hydrate production horizontal well 10 under the action of formation pressure and then enters the natural gas production well 12 together with the heat-carrying fluid, and thereby the natural gas hydrate in the shallow hydrate reservoir 9 is recovered.

Both the injection well 4 and the natural gas production well 12 are formed as vertical wells, the hydrate production horizontal well 10 is formed as a horizontal well, and the distance between the central axis of the hydrate production horizontal well 10 and the top surface of the shallow hydrate reservoir 9 is approximately ½-¼ of the overall depth of the shallow hydrate reservoir 9. Such a design is beneficial for the downward flow of the hot fluid with higher density and the upward collection of the gas with lower density.

In the scheme, a high curvature connecting well 7 at a greater depth is provided upstream of the hydrate production horizontal well 10, and the high curvature connecting well 7 is connected to the hydrate production horizontal well 10 through the rising well section 8. It has higher stability and improves production efficiency.

Wherein, the upper part of the natural gas production well 12 is provided with an inner riser pipe 24 therein, and a riser annulus 25 is formed between the natural gas production well 12 and the inner riser pipe 24. A riser annulus 25 is formed between the natural gas production well 12 and the inner riser pipe 24, and the outlet end of the hydrate production horizontal well 10 is connected to the side of the natural gas production well 12 (the side wall of the natural gas production well 12 forms an opening to communicate with the hydrate production horizontal well 10) to communicate with the riser annulus 25, thereby the decomposed natural gas and the heat-carrying fluid can be conveyed into the inner riser pipe 24 and the riser annulus 25 to facilitate further conveying of the natural gas and the heat-carrying fluid.

Furthermore, the lower end of the inner riser pipe 24 is provided with a downhole separator 14, which is in connect with the inner riser pipe 24 and the riser annulus 25. The downhole separator 14 can achieve gas-liquid separation, so that the gas enters the inner riser pipe 24 while the hot fluid enters the riser annulus 25.

Moreover, the natural gas production well 12 is provided with a driving pump 13 therein, which is in connect with the downhole separator 14. The driving pump 13 may be an electric submersible pump, which may be used to reduce the wellbore pressure of the hydrate production horizontal well 10, lift the produced gas, and increase the speed of the produced fluid flowing into the downhole separator 14 through the inlet.

Furthermore, the driving pump 13 is adjacent to the outlet end of the hydrate production horizontal well 10. As shown in FIG. 1, the driving pump 13 is located near the outlet end of the hydrate production horizontal well 10; for example, the driving pump 13 is located at the upper side of the outlet end of the hydrate production horizontal well 10 to deliver the fluid from the hydrate production horizontal well 10 to the inner riser pipe 24.

Optionally, the hydrate production horizontal well 10 is provided with a memory alloy screen pipe therein. The memory alloy screen pipe may be formed into a required shape to adapt to an irregular external installation environment, and thereby may be used as a supporting structure for the hydrate production horizontal well 10. A plurality of through-holes are distributed in the pipe wall of the screen pipe, and the fluid inside/outside the screen pipe can flow out of/into the screen pipe via the through-holes. With the screen pipe, the wellbore stability of the hydrate production horizontal well 10 can be enhanced, and, at a certain flow rate, local low pressure is generated in the screen pipe, which is helpful for the raw fluid in the hydrate reservoir 9 to flow into the sieve pipe. Of course, the present invention is not limited to that, which is to say, the hydrate production horizontal well 10 may employ any other pipe fitting that can implement the above function.

Moreover, the high curvature connecting well 7 can absorb heat in the formation 6 below the hydrate reservoir. If the geothermal gradient of the formation 6 below the hydrate reservoir is sufficient, the high curvature connecting well 7 can also use geothermal energy to heat the heat-carrying fluid, thereby reducing energy consumption.

Wherein, the outlet end of the hydrate production horizontal well 10 is provided with a check valve 11. The check valve 11 enables the fluid in the hydrate production horizontal well 10 to enter the natural gas production well 12 in one direction to prevent the natural gas produced in other formation zones (e.g., deep gas reservoir zone 16) from entering the hydrate production horizontal well 10, which may cause blockage.

Specifically, the lower part of the natural gas production well 12 may be in connect with a shallow free gas formation zone 15 and a deep gas reservoir zone 16. The downhole separator 14 can perform preliminary gas-liquid separation for the natural gas produced in the shallow free gas formation zone 15, the deep gas reservoir zone 16 and the natural gas hydrate production horizontal well 10, so that the gas enters the inner riser pipe 24, while the liquid enters the riser annulus 25.

Moreover, the inlet end of the injection well 4 is arranged on a mobile barge 1, which is provided with an injection circulating pump 2 connected to the injection well 4. The mobile barge 1 may be used as a fixed operating platform for the injection well 4. A heat-carrying fluid may be injected by means of the injection circulating pump 2 into the injection well 4, and the heat-carrying fluid may be sea water or other replacement gas (such as carbon dioxide).

Moreover, the outlet end of the natural gas production well 12 is installed on an offshore platform 17, which is provided with a fine gas-liquid separation device 19, a recovery circulating pump 20, a natural gas storage tank 18 and a liquid recovery tank 21. The recovery circulating pump 20 can provide recovery power for the natural gas production well 12 to recover the fluid in the inner riser pipe 24 and the riser annulus 25. The fine gas-liquid separation device 19 can further perform gas-liquid separation for the recovered fluid, including separating the liquid from the inner riser pipe 24 and the gas in the riser annulus 25. The natural gas storage tank 18 and the liquid recovery tank 21 are respectively used to store the gas and the liquid and deliver natural gas to costomers.

Owing to the characteristics of the natural gas hydrate in marine shallow formations, such as shallow burial depth, weak consolidation or non-consolidation, instability, and lack of roof rock, etc., it is risky to directly perform conventional horizontal well drilling operations. With the novel well structure described above, The present invention overcomes the drawback of wellbore instability in the kick-off section of the shallow horizontal well, and realizes combined recovery of marine natural gas hydrate resources and conventional gas reservoirs, and improves the resource recovery efficiency.

While the present invention is described above in detail in some preferred embodiments with reference to the accompanying drawings, the present invention is not limited to those embodiments. Different simple variations can be made to the technical scheme of the present invention within the scope of the technical concept of the present invention, including combining the specific technical features in any proper way. Various possible combinations are not described in the present invention, in order to avoid unnecessary repetitive description. However, such simple variations and combinations shall also be deemed as having been disclosed and falling in the scope of protection of the present invention.

What is claimed is:

1. A well structure for natural gas hydrate production, comprising:

a natural gas production well that is able to be in connect with a shallow free gas formation zone and a deep gas reservoir zone;

an injection well capable of injecting a heat-carrying fluid;

a curved connecting well, an inlet end of the curved connecting well is connected to an outlet end of the injection well, and two ends of the curved connecting well are bent upwards;

a hydrate production horizontal well, which is able to be arranged in a shallow hydrate reservoir above a diagenetic sediment layer and connected with the natural gas production well, wherein the curved connecting well and the hydrate production horizontal well are connected by an ascending well section, and, wherein the curved connecting well is configured to be arranged in a formation below the hydrate reservoir in the diagenetic sediment layer and absorb the heat in the formation below the hydrate reservoir.

2. The well structure for natural gas hydrate production according to claim 1, wherein the upper part of the natural gas production well is provided with an inner riser pipe therein, and a riser annulus is formed between the natural gas production well and the inner riser pipe.

3. The well structure for natural gas hydrate production according to claim 2, wherein the lower end of the inner riser pipe is provided with a downhole separator, which is in connect with the inner riser pipe and the riser annulus.

4. The well structure for natural gas hydrate production according to claim 3, wherein the natural gas production well is provided with a driving pump therein, which is in connect with the downhole separator.

5. The well structure for natural gas hydrate production according to claim 4, wherein the driving pump is adjacent to the outlet end of the hydrate production horizontal well.

6. The well structure for natural gas hydrate production according to claim 1, wherein the hydrate production horizontal well is provided with a memory alloy screen pipe therein.

7. The well structure for natural gas hydrate production according to claim 1, wherein an outlet end of the hydrate production horizontal well is provided with a check valve.

8. The well structure for natural gas hydrate production according to claim 1, wherein the inlet end of the injection well is arranged on a mobile barge, which is provided with an injection circulating pump connected to the injection well.

9. The well structure for natural gas hydrate production according to claim 1, wherein the outlet end of the natural gas production well is installed on an offshore platform, which is provided with a fine gas-liquid separation device, a recovery circulating pump, a natural gas storage tank and a liquid recovery tank.

* * * * *